United States Patent [19]

Nishimaki et al.

[11] 4,090,460

[45] May 23, 1978

[54] SPHERICAL TANK SUPPORTING SYSTEM FOR LOW TEMPERATURE LIQUIFIED GAS STORAGE TANK CARRYING VESSEL

[75] Inventors: Ko Nishimaki; Tomiyasu Okamoto; Tsunanori Nishimoto; Taiji Kataza; Koji Harada; Seiichiro Murata; Masayoshi Higashimura; Takanori Ito, all of Osaka, Japan

[73] Assignee: Hitachi Shipbuilding & Eng. Co., Ltd., Osaka, Japan

[21] Appl. No.: 733,075

[22] Filed: Oct. 18, 1976

[30] Foreign Application Priority Data

| | | |
|---|---|---|
| Oct. 20, 1975 | Japan | 50-126595 |
| Oct. 20, 1975 | Japan | 50-126596 |
| Oct. 20, 1975 | Japan | 50-126597 |

[51] Int. Cl.[2] ..... B63B 25/08

[52] U.S. Cl. ..... 114/74 A

[58] Field of Search ..... 114/74 A, 74 R; 220/9 LG, 15

[56] References Cited

U.S. PATENT DOCUMENTS

| | | | |
|---|---|---|---|
| 3,680,323 | 8/1972 | Bognaes et al. | 114/74 A X |
| 3,770,158 | 11/1973 | Alleame | 114/74 A X |
| 3,899,988 | 8/1975 | Menendez | 114/74 A |
| 3,957,170 | 5/1976 | Kotcharian | 114/74 A X |
| 4,000,711 | 1/1977 | Okamoto et al. | 114/74 A |

FOREIGN PATENT DOCUMENTS

| | | | |
|---|---|---|---|
| 808,739 | 2/1959 | United Kingdom | 114/74 A |

*Primary Examiner*—Robert B. Reeves
*Assistant Examiner*—Edward M. Wacyra
*Attorney, Agent, or Firm*—Joseph W. Farley

[57] ABSTRACT

A support deck extends on a level above the bottom of a hold of a vessel carrying low temperature liquified storage spherical tanks, from bulkheads of the hull so as to surround such spherical tanks, while a horizontal support ring projects from the outer surface of the spherical tank and is supported on the support deck through support chocks. The circular inner peripheral edge of the support deck is supported by brackets erected on the bottom plate of the hold and radially extending toward the bulkheads or by columns erected on the bottom plate of the hold. In one construction, the inner peripheral edge of the support deck has an annular girder attached to the under side thereof and such girder is supported by brackets or columns. Further, in another construction, arcuate girders are provided only in regions close to longitudinal or transverse bulkheads and supported by brackets, and adjacent girders are interconnected by an arcuate leg plate erected on the bottom plate of the hold.

2 Claims, 9 Drawing Figures

Figure 1A:
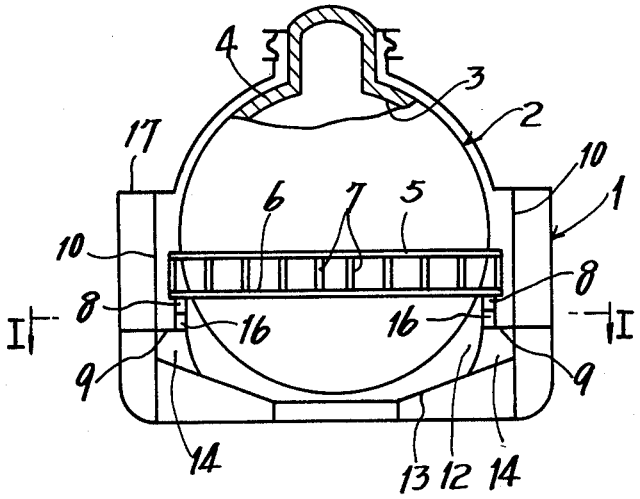

SPHERICAL TANK SUPPORTING SYSTEM FOR LOW TEMPERATURE LIQUIFIED GAS STORAGE TANK CARRYING VESSEL

The present invention relates to a tank supporting system for a low temperature liquified gas carrying vessel having spherical tanks mounted thereon.

Known means for supporting a spherical tank include a system in which it is supported by columns and another system in which it is supported by skirts. Application of these systems to a vessel-carried spherical tank necessitates using long support members, which are subjected to a bending moment, and hence a large support structure to prevent buckling. Since such suuport members undulate as a result of expansion and contraction of the tank caused by taking in and out a low temperature liquid, it is impossible to support the tank by axial forces along. As a countermeasure against this situation, it would be conceived to slidably support the support members themselves on which the tank is mounted or to support the tank so as to be slidable relative to the support members, but it would be difficult to employ such means since the support members are long. Eventually, with the conventional support systems there is no choice but to employ a support structure designed with the bending moment taken into consideration.

The main object of the present invention is to provide a spherical tank supporting system which eliminates all these drawbacks and in which a support deck is separately constructed on a level above the bottom of a hold of a vessel around the lateral sides of the hold so as to minimize the length of support members and slidably support a spherical tank at the position of said support deck, whereby the support structure for the spherical tank is simplified and the tank is supported in such a manner that it can hardly be influenced by deformation of the hull. Thus, the invention provides a spherical tank supporting system comprising a support deck extending horizontally from bulkheads on a level above the bottom of a hold of a vessel carrying a spherical tank thereon, said support deck having a circular opening whose periphery surrounds such spherical tank, support means projecting from the inner shell of the hull to support the inner peripheral edge of said support deck, a support ring horizontally projecting from the outer surface of the spherical tank, and a number of support chocks projecting from the lower surface of said support ring so that the latter can be supported on said support deck through said support chocks.

Another object of the invention is to provide such system in which said support deck is designed to be strong and assure smooth transmission of loads, simple in construction, light in weight and inexpensive. Thus, according to the above-mentioned support sytem, reduction of the length of the support device rationalizes support of the tank, but, on the other hand, the support device tends to be a heavy structure since a number of support means must be arranged on the lower surface of the support deck around the inner peripheral edge thereof so as to be opposed to the support chocks before the load of the spherical tank can be uniformly distributed over the hull. Accordingly, in the present invention, an annular girder is attached to the under side of said support deck around the inner peripheral edge thereof and is supported by support means projecting from the inner shell of the hull. Desirably, such support means comprises a plurality of brackets provided in regions where the annular girder and the bulkheads are close to each other and having their base end fixed along the bulkheads and the bottom of the hold. In this case, the size and number of brackets can be reduced while achieving a high strength.

Further, the invention provides a support system in which said annular girder is replaced by arcuate girders which are used in regions close to the bulkheads and supported by brackets while arcuate leg plates extending between the under side of the support deck and the bottom of the hold are used for support between adjacent arcuate girders.

Other numerous features and merits of the invention will be readily understood from the following description of preferred embodiments of the invention with reference to the accompanying drawings.

IN THE DRAWINGS

Figure 1B:
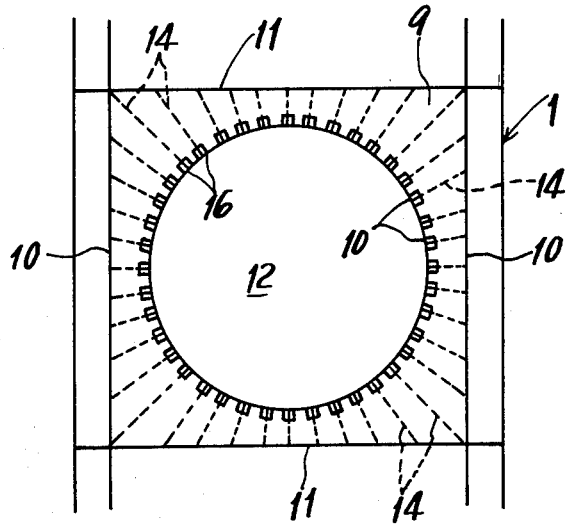

FIGS. 1*a* and 1*b* show a first embodiment of the invention, in which FIG. 1*a* is a partly broken-away cross-sectional view of a low temperature liquified gas carrying vessel having spherical tanks and FIG. 1*b* is a plan view in section taken along the line I—I of FIG. 1*a;*

Figure 2:
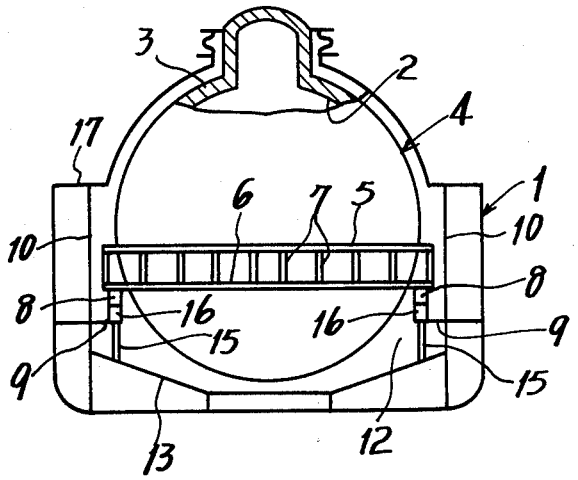
Figure 3A:
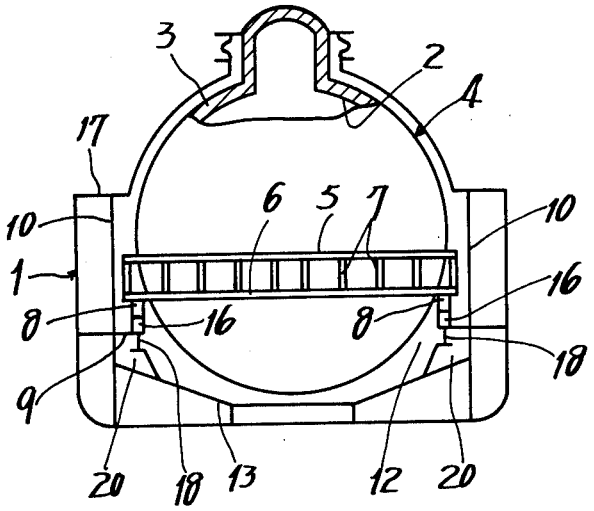
Figure 3B:
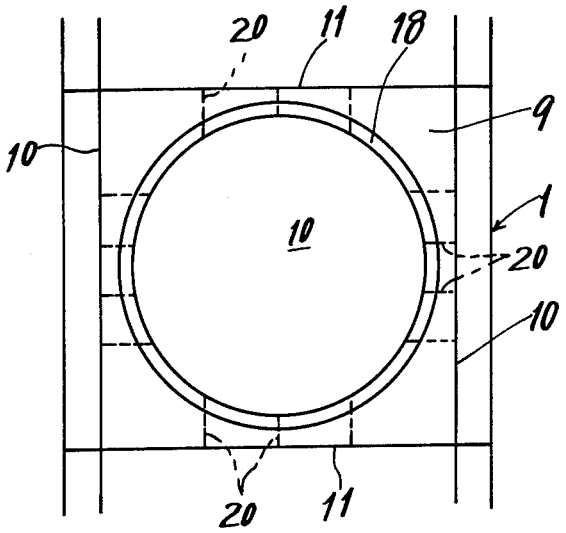
Figure 4:
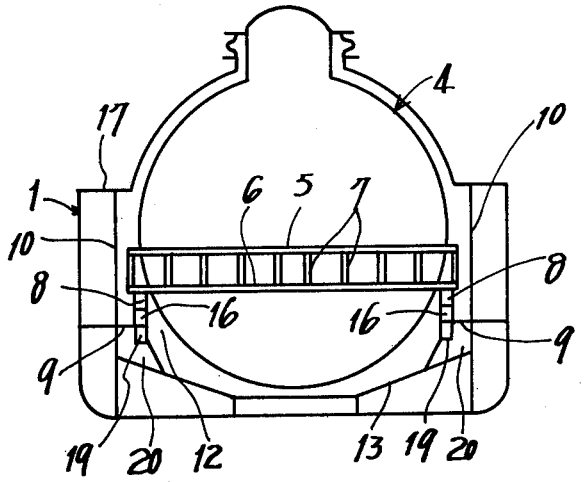
Figure 5A:
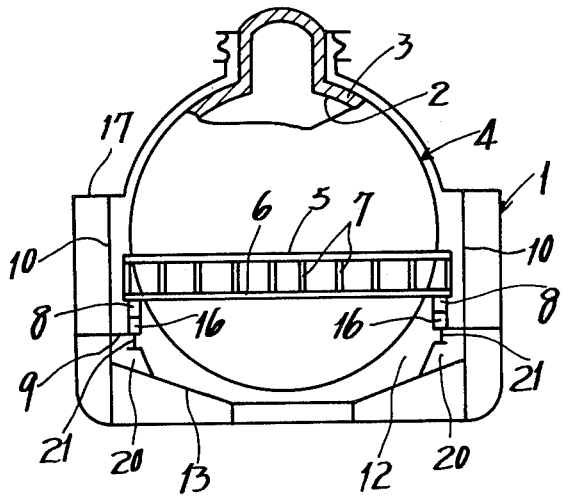
Figure 5B:
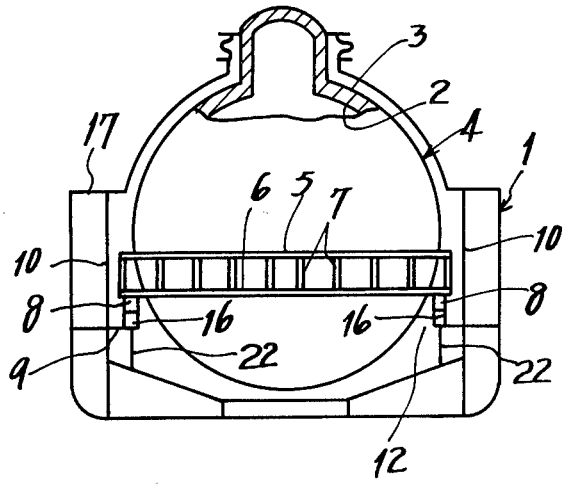
Figure 5C:
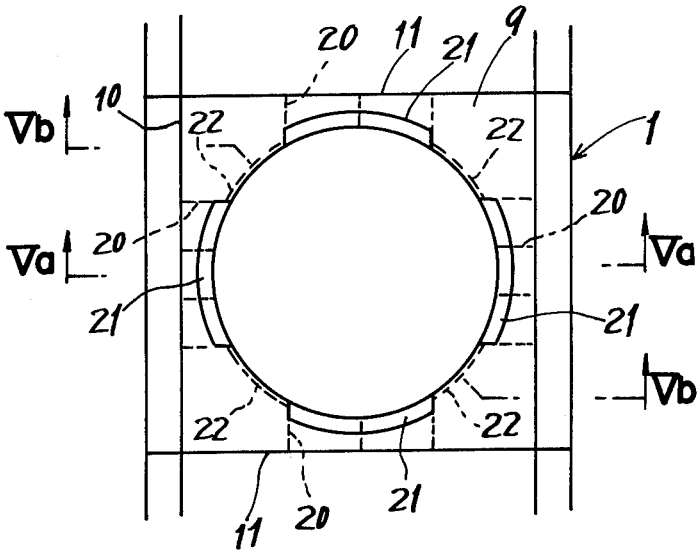

FIG. 2 is a view similar to FIG. 1*a* but showing a modification of the first embodiment;

FIGS. 3*a* and 3*b* show a second embodiment of the invention, in which FIG. 3*a* is a view similar to FIG. 1*a* and FIG. 3*b* is a view similar to FIG. 1*b* but support blocks are omitted;

FIG. 4 is a view similar to FIG. 1*a* but showing a modification of the second embodiment; and FIGS. 5*a,* 5*b,* and 5*c* show a third embodiment of the invention, in which FIGS. 5*a* and 5*b* are views similar to FIG. 1*a,* FIG. 5*a* being a section taken along the line Va—Va of FIG. 5*c,* FIG. 5*b* being a section taken along the line Vb—Vb of FIG. 5*c,* and FIG. 5*c* is a view similar to FIG. 3*b.*

A first embodiment of the invention will be described with reference to FIGS. 1*a,* 1*b* and 2. Designated at 1 is a hull having, usually, a plurality of spherical tanks 2 mounted thereon. The numeral 3 designates a heat insulating device attached to the surface of such spherical tank 2 and 4 designates the outer surface of the heat insulating device. Designated at 5 and 6 are horizontal upper and lower support rings horizontally porjecting from around the periphery of the tank in a region in the vicinity of the equator of the spherical tank 2 and a second circumferential region therebelow. Designated at 7 are stiffeners interposed between these two support rings 5 and 6. Designated at 8 are circumferentially substantially equispaced chocks attached to the lower surface of the lower support ring 6. Designated at 9 is a support deck horizontally inwardly extending from the sides of the hold, i.e., longitudinal bulkheads 10 and transverse bulkheads 11, so as to surround the spherical tank 3 and is centrally formed with a spherical-tank mounting space 12. The support deck 9, as shown in FIGS. 1*a* and 1*b,* is supported by brackets 14 erected on the bottom 13 of the hold to extend from the inner peripheral edge of the support deck 9 radially toward the longitudinal bulkheads 10 or transverse bulkheads 11. Such support means may be replaced by columns 15 erected on the hold bottom 13, as shown in FIG. 2. Further, pressure-resistant support blocks 16 are provided on the inner edge of the support deck 9 for supporting the support chocks 8 with a suitable pressure-resistant heat insulating material interposed therebetween. In addition, the support chocks 8 are supported on the pressure-resistant support blocks 16 so as to be slidable radially of the tank 2, and said brackets 14 or columns 15 are disposed just below such support structures disposed at a plurality of circumferential places. Designated at 17 is an upper deck.

According to this arrangement, since the support device is short in length and has a slidable support construction, it is subjected only to axial forces and simple in construction and light in weight. Further since, the tank supporting position can be located in the vicinity of the hull's longitudinal bending center, the tank can be securely supported without being influenced by deformation of the hull.

A second embodiment of the invention will now be described with reference to FIGS. 3*a*, 3*b* and 4. In addition, those parts which are the same as those described in the first embodiment are given the same reference numerals and a description thereof is omitted. Designated at 18 is an annular girder attached to the under side of the support deck 9 around the inner edge thereof, and the one shown in FIG. 3*a* consists of an annular member of I-shaped cross-section. The annular girder 18 may be replaced by a box-shaped annular member 19 of rectangular cross-section, as shown in FIG. 4. Designated at 20 are brackets supporting the annular girder 18 at a plurality of circumferential places. In regions where the annular girder 18 and the longitudinal bulkheads 10 or transverse bulkheads 11 are close to each other, said brackets 20 have their base ends welded along the bulkheads 10, 11 and the hold bottom 13 and extend at right angles with the bulkheads 10, 11 and are welded to the lower surface of the support deck 9 and annular girder 18. As such support means, the brackets 20 could be replaced by the columns 15 as in the first embodiment, but in this embodiment, the brackets 20 may be small in size while retaining high strength and hence the number of support means may be small. Further, said pressure-resistant support blocks 16 are fixed on the annular girder 18 or 19.

According to this arrangement, the pressure-resistant support blocks 16 are associated with the support chocks 8 and disposed at suitable intervals, so that even if a local load acts on a region of the inner peripheral edge of the support deck 9 where a support block 16 is attached, the load is once supported by the annular girder 18 or 19 and evenly distributed and the load supported by the annular girder 18 or 19 is transmitted to the hull mainly through the brackets 20 or columns, so that the construction of the support deck can be simplified and the number of support means may be small.

A third embodiment of the invention will now be described with reference to FIGS. 5*a*, 5*b* and 5*c*. In this case also, the parts referred to in the first embodiment are given the same reference numerals and a description thereof is omitted. Designated at 21 are arcuate girders disposed under the support deck 9 along the inner peripheral edge thereof at places close to the longitudinal and transverse bulkheads 10 and 11. These arcuate girders 21 are supported by a plurality of brackets 20 having their base ends welded along the bulkheads 10, 11 and the hold bottom 13. Designated at 22 are arcuate leg plates disposed along the inner periheral edge of the support deck 9 and extending between the hold bottom 13 and regions of the under side of the support deck where said arcuate girders do not exist. In addition, the pressure-resistant support blocks are fixed at suitable intervals on the arcuate girders 21 and on said girderless regions of inner peripheral edge of the support deck 9. Further, the illustrated arcuate girders 21 are of I-shaped cross-section, but they may, of course, have a rectangular cross-section.

According to this arrangement, local loads act on the regions of the inner peripheral edge of the support deck 9 where the pressure-resistant support blocks 16 are attached, but the loads acting on the support blocks disposed on the arcuate girders 21 can be circumferentially distributed by the arcuate girders 21 and the brackets 20 allow the loads to be shared by the bulkheads 10, 11 and the hold bottom 13. Although the remaining support blocks are supported by the support deck 19 in other regions than those having said arcuate girders 21, the loads locally acting on the inner peripheral edge of the support deck can be distributed circumferentially of said arcuate legs 22 by interconnecting the inner peripheral edge of the support deck and the hold bottom 13 by the arcuate legs 22 extending along said inner peripheral edge. Further, the arcuate leg plates 22 can be easily installed regardless of the bulkheads 10, 11, and support of the tank from the hull side can be firmly and securely effected. Further, according to this arrangement, the regions defined by the brackets on two sides, arcuate leg plates, longitudinal bulkheads, transverse bulkheads and hold bottom, i.e., the four corners of the space defined under the support deck, are separated from the rest of said space and hence the amount of inert gas charged into said rest of said space can be reduced.

We claim:

1. A spherical tank supporting system for a low temperature liquified gas storage tank carrying vessel, comprising:

a hold defined by bulkheads to form a spherical tank receiving compartment;

a support deck extending horizontally from said bulkheads at a level above the bottom of the hold, said support deck having a circular opening whose periphery surrounds said spherical tank;

an annular girder extending around and reinforcing the whole of the inner peripheral edge of the support deck, said annular girder having an I-shaped or rectangular cross section;

support means carried by the hull for supporting said support deck and annular girder, said support means comprising a number of brackets extending from the annular girder and the lower surface of the support deck to the bottom of the hold and connected at right angles to said bulkheads, the portions of the annular girder facing the corners of the hold being supported by a number of columns extending between the lower surface of the annular girder and the bottom of the hold;

a support ring horizontally projecting from the outer surface of the spherical tank;

a number of support chocks projecting from the lower surface of said support ring; and pressure-resistant blocks attached to the support deck in opposed relation to said support chocks to radially slidably support the latter.

2. A spherical tank supporting system for a low temperature liquified gas storage tank carrying vessel, comprising:

a hold defined by bulkheads to form a spherical tank receiving compartment;

a support deck extending horizontally from said bulkheads at a level above the bottom of the hold, said support deck having a circular opening whose periphery surrounds said spherical tank;

an annular girder extending around and reinforcing the whole of the inner peripheral edge of the support deck, said annular girder having an I-shaped or rectangular cross section;

support means carried by the hull for supporting said support deck and annular girder, said support means comprising a number of brackets extending from the annular girder and the lower surface of the support deck to the bottom of the hold and connected at right angles to said bulkheads, the portions of the annular girder facing the corners of the hold being supported by arcuate leg plates extending between the lower surface of the annular girder and the bottom of the hold;

a support ring horizontally projecting from the outer surface of the spherical tank;

a number of support chocks projecting from the lower surface of said support ring; and pressure-resistant blocks attached to the support deck in opposed relation to said support chocks to radially slidably support the latter.

* * * * *